United States Patent [19]

Sando et al.

[11] 4,190,966

[45] Mar. 4, 1980

[54] WIPING AND DRYING DEVICE FOR AN INLET SEAL ROLLS ON A HIGH PRESSURE STEAMER

[75] Inventors: Yoshikazu Sando; Hiroshi Ishidoshiro, both of Wakayama, Japan

[73] Assignee: Sando Iron Works, Co. Ltd., Wakayama, Japan

[21] Appl. No.: 902,688

[22] Filed: May 4, 1978

[30] Foreign Application Priority Data

May 23, 1977 [JP] Japan ..... 52/59682

[51] Int. Cl.[2] ..... D06B 23/18

[52] U.S. Cl. ..... 34/242; 8/149.3; 68/5 E

[58] Field of Search ..... 34/85, 95, 95.3, 242, 34/92, 15, 16, 51; 68/5 E; 8/149.3

[56] References Cited

U.S. PATENT DOCUMENTS

| | | | |
|---|---|---|---|
| 4,017,258 | 4/1977 | Sando et al. | 34/242 X |
| 4,064,582 | 12/1977 | Sando et al. | 8/149.3 |
| 4,112,713 | 9/1978 | Sando et al. | 34/242 X |
| 4,121,441 | 10/1978 | Sando et al. | 68/5 E |

*Primary Examiner*—Edward G. Favors

*Attorney, Agent, or Firm*—Toren, McGeady and Stanger

[57] ABSTRACT

A wiping and drying device for an inlet seal roll provided on a high pressure steamer, which is characterized in that a cleaning and wiping member is made to contact a part of the surface of the sealing rubber roll before the part contacts a fiber product and further that a drying member for drying the cleaning and wiping is provided.

6 Claims, 4 Drawing Figures

WIPING AND DRYING DEVICE FOR AN INLET SEAL ROLLS ON A HIGH PRESSURE STEAMER

BACKGROUND OF THE INVENTION

1. Field of the Invention

The present invention relates to a device which constantly wipes sealing rolls provided at an inlet of a high pressure steamer used for wet heat treatment under high pressure of fiber products for enhancing the processing quality of the fiber products to be processed which is guided by said sealing rolls and is fed into the steamer.

A high pressure steamer, in which saturated steam of high temperature and high pressure is applied to fiber products such as cloth, string, etc. for conducting high pressure wet heat treatment such as color developing process on said fiber products, has been already publicly known. A number of sealing apparatuses have been proposed by the present inventors which feed fiber products into a high pressure steamer or to take out the same from the steamer while the temperature and the pressure within the steamer are maintained at such a high temperature and pressure as, for example, 160° C., 5.5 kg/cm$^2$.

A basic structure of the sealing apparatus which has been proposed by the present inventors is such that, as shown in FIG. 1, a pair of sealing rubber rolls (3) which blocks and closes an inlet for introducing fiber products (2) provided at a sealing block (1) and is designed to be driven in such a direction as to feeding the fiber products into the high pressure steamer and nozzles (4) and tanks (5) to wash, clean and cool said sealing rubber rolls (3) are provided, further brush rolls (6) and water squeezing-out rolls (7) are made to move in contact with both sealing rubber rolls (3). Therefore, both of the sealing rubber rolls (3) will have cleaning liquid given thereto then water is squeezed out therefrom by water squeezing-out rolls (7) after being brushed in every one rotation.

However, while water is largely squeezed out of the surfaces of the sealing rubber rolls (3) by an action of the water squeezing-out rolls (7) in the above structure, it is impossible to remove water from the surfaces of the sealing rubber rolls to such extent as making the surfaces dry, instead the surfaces of the sealing rubber rolls are left in wet state. Therefore the moisture of the sealing rubber rolls is transferred to the fiber product (8) to be fed into the high pressure steamer, thus undesirable effects are given to the processing of the fiber products by said transferred moisture. For example, when the fiber product (8) is fed into the high pressure steamer for the purpose of dyeing, it has been found from experiments that dye adhesion will become inferior because of the action of the transferred moisture and dark dyeing cannot be done. Particularly when the fiber product is nylon taffeta, such defects cannot be avoided so that dyeing speck is caused and the dyeing is ended up with light shade.

SUMMARY OF THE INVENTION

The present invention is made in view of the above and has developed a wiping and drying device for sealing rolls provided on a high pressure steamer which is made so that surfaces of the sealing rubber rolls are maintained in a dry state at least when the sealing rolls contact the fiber products.

Now the present invention will be explained in detail referring to examples shown in the drawings.

BRIEF EXPLANATIONS OF THE DRAWINGS

EXAMPLE 1

Figure 1:
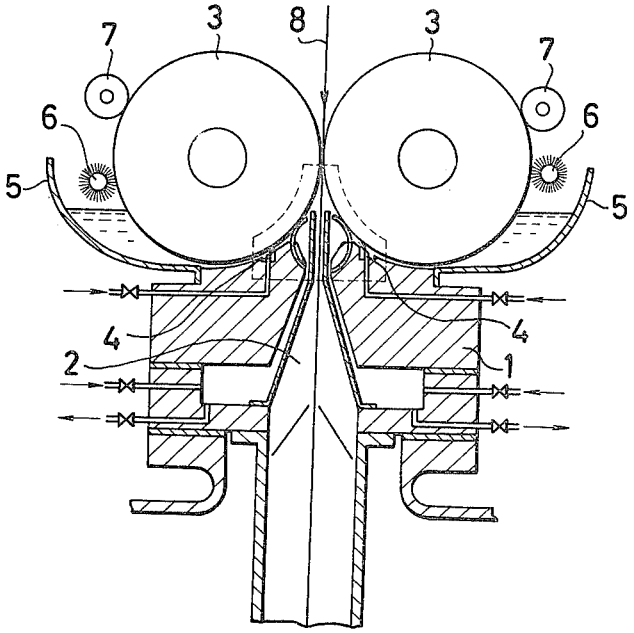
FIG. 1 is a cross sectional view showing a conventional sealing apparatus.
Figure 2:
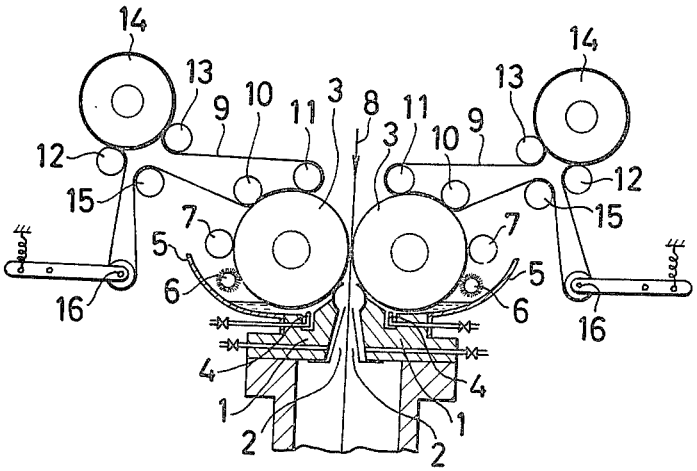
FIG. 2 is a cross sectional view illustrating Example 1 of a sealing apparatus having a cleaning and wiping device according to the present invention.

In FIG. 2, what is shown as (1) is a sealing block, (2) is an inlet for fiber products, (3) are sealing rubber rolls, (4) are cleaning nozzles, (5) are cleaning and cooling tanks, (6) are brush rolls, and (7) are water squeezing-out rolls, wherein a sealing mechanism made of these component members has same structure as that of a sealing apparatus with conventional structure shown in FIG. 1, therefore explanations of the structure will be omitted. What are shown as (9) are cleaning and wiping cloths of an endless belt shape and are made of comparatively bulky cloth with a good water absorption characteristic. The cleaning and wiping cloths (9) are so positioned as contacting portions of circumferences (between the squeezing rolls (7) and fiber product (8) of sealing rubber rolls (3) by guide rolls (10) (11), and at the same time are so guided by other guide rolls (12), (13) as contacting the circumference of the heating and drying roll or cylinders (14), further are so guided by the guide rolls (15) as engaging with a tension adjusting roll (16). That is, the cleaning and wiping belts of cloth (9) have desired tensile force working thereon by the action of the tension adjusting roll (16), thereby the cleaning and wiping belts of cloth (9) will make face contact with the surfaces of the sealing rubber rolls (3) with a desired pressure, further the belts of cloth (9) will contact the sealing rubber rolls (3) always in a dry state because they are dried by the drying roller cylinders (14). Therefore, every time the sealing rubber rolls make one rotation, the sealing rubber rolls are cleaned by the brush rolls (6) and are pressed by the water squeezing-out rolls (7) to have water squeezed out then the dried belts of cloth (9) contact the still wet surfaces of the sealing rubber rolls and wipe the same, thus the sealing rubber rolls will contact the fiber product (8) in a completely dry state, therefore the conventional problem caused by transfer of extraneous moisture to the fiber product is eliminated, and for example, dark color dyeing can be done without dyeing speck. For example, there is such effect that while a continuous dyeing of a cloth like nylon taffeta has been deemed to be impossible because of its nature, comparatively darker color dyeing can be done continuously on a cloth of nylon taffeta with same dyestuff and dyeing apparatus but without dyeing speck by using the device according to the present invention. In this embodiment it is preferable that the cleaning and wiping belts of cloth contacting the sealing rubber rolls are rotated in a direction reverse to the rotating direction of the sealing rubber rolls.

EXAMPLE 2

Figure 3:
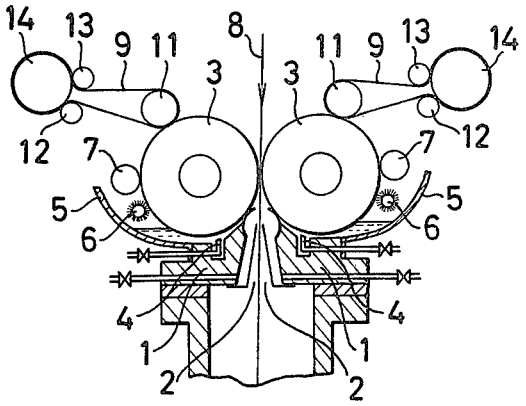
FIG. 3 is a cross sectional view displaying Example 2 of the present invention.

This example shown in FIG. 3 is to reduce the number of many guide rolls required in the embodiment of Example 1, and in this example since the contacting area between the dry cleaning and wiping belts of cloth (9) and the sealing rubber rolls is small, a cleaning and wiping efficiency is lower than that in Example 1, but the number of the guide rolls is reduced thus the size of the device is made smaller and also the capital cost is reduced.

EXAMPLE 3

Figure 4:
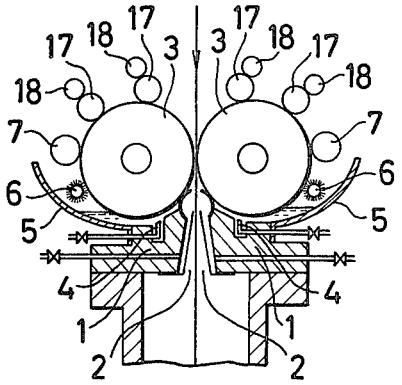
FIG. 4 is a cross sectional view showing Example 3 of the present invention.

In this example shown in FIG. 4 two sponge rolls (17) are arranged in spaced relation and are made to contact the surfaces of the sealing rubber rolls (3) between the water squeezing-out rolls (7) and the portions of the seal rolls which contact the fiber product (8), and heating and drying rolls (18) are made to contact the sponge rolls (17) to dry them respectively, and because the cleaning and wiping endless belts of cloth are not provided in this example the device can be made more compact and smaller. However, because the area of contacting surfaces of the heating rolls (18) and the sponge rolls (17) is small in this example, drying efficiency of the sponge rolls is low hence the degree of drying of the sealing rubber rolls is somewhat lowered, but an object of the present invention itself can be achieved.

What is claimed is:

1. A wiping and drying device for an inlet seal roll located on a high pressure steamer which is utilized for treating fiber products, comprising cleaning and wiping means arranged to contact directly a part of the surface of the seal roll and means disposed in direct contact with said cleaning and wiping means and located in spaced relation to the inlet seal roll for drying said cleaning and wiping means so that the cleaning and wiping means are dry when said means contact the inlet seal roll.

2. A wiping and drying device according to claim 1 in which said cleaning and wiping means is an endless belt of cloth.

3. A wiping and drying device according to claim 1 in which said cleaning and wiping means is a sponge roll.

4. A wiping and drying device according to claim 1 in which said drying means is a heating and drying roll in direct contact with the cleaning and wiping means.

5. A wiping and drying device according to claim 2 in which said endless belt of cloth is rotated in a counter direction to the rotation of the seal roll.

6. A wiping and drying device according to claim 2 in which a pair of guide rolls are positioned adjacent the inlet seal roll and said endless belt of cloth passes over said guide rolls and is made to contact the part of the surface of the seal roll by means of said pair of guide rolls and a tension roll is disposed in contact with and tensions said endless belt of cloth.

* * * * *